United States Patent [19]

Hove

[11] Patent Number: 4,957,399

[45] Date of Patent: Sep. 18, 1990

[54] METHOD FOR CUSHIONING A CONTAINERIZED SHIPMENT BY RAILROAD FLATCAR

[75] Inventor: Anders Hove, Stockholm, Sweden

[73] Assignee: Buffers AB, Taby, Sweden

[21] Appl. No.: 406,866

[22] Filed: Sep. 13, 1989

Related U.S. Application Data

[62] Division of Ser. No. 121,216, Nov. 16, 1987, abandoned.

[51] Int. Cl.[5] ..... B61P 45/00; B60D 1/64

[52] U.S. Cl. ..... 410/87; 410/88

[58] Field of Search ..... 410/2, 52, 54, 71, 72, 410/73, 74, 75, 76, 77, 80, 82, 83, 86, 87, 88, 90, 91

[56] References Cited

U.S. PATENT DOCUMENTS

| | | | |
|---|---|---|---|
| 3,167,028 | 1/1965 | Gutridge et al. | 410/86 |
| 3,251,314 | 5/1966 | Gutridge | 410/86 |
| 3,701,562 | 10/1972 | Carr | 410/82 |
| 4,026,596 | 5/1977 | Carr | 410/82 |
| 4,321,000 | 3/1982 | Novak | 410/76 |
| 4,419,034 | 12/1983 | DiMartino | 410/77 X |

*Primary Examiner*—Andres Kashnikow
*Assistant Examiner*—Virna Lissi Mojica
*Attorney, Agent, or Firm*—Cushman, Darby & Cushman

[57] ABSTRACT

A device for fastening containers and shifting platforms onto railroad cars using container pins fixed in a movable frame. The frame is fixed on the floor of a railroad car by a double-acting cushioning means.

4 Claims, 3 Drawing Sheets

METHOD FOR CUSHIONING A CONTAINERIZED SHIPMENT BY RAILROAD FLATCAR

This is a division of application Ser. No. 07/121,216, filed Nov. 16, 1987, which was abandoned upon the filing hereof.

BACKGROUND OF THE INVENTION

This invention relates to a method for fastening containers and shifting platforms onto railroad cars by means of container pins fixed in a frame.

Damaged goods cause railway administrations all over the world a lot of trouble and big sums every year. Goods transported in containers are usually packed with small impact-protecting devices to make it easier for suppliers and consignees, but the goods are still easily damaged by the jerks and bumps occurring when the container is transported on a railroad car. Most container transports by rail take place on usual open-sided wagons, damage to the goods being a common consequence. However, for several years, special wagons for container transport have been available. These wagons have a built-in shock absorber making transports less harmful to the goods. However, it is expensive to procure these special wagons, and, as a result, containers continue to be transported on the large number of usual open-sided wagons still existing in each railway administration.

SUMMARY OF THE INVENTION

It is therefore the object of this invention to provide a method making it possible to transport containers on a usual open-sided wagon with the same carefulness as on the abovementioned special wagons for container transport.

Another object of the invention is to embody the device so that the height of the container pins can be varied and both shifting platforms and usual containers can be transported on the load profiles of wagons of the respective railway administrations by means of devices for performing the method according to the invention.

BRIEF DESCRIPTION OF THE DRAWINGS

The invention is now described in greater detail in the form of a non-restricting illustrative example of a device for performing the method according to the invention, wherein.

DETAILED DESCRIPTION

Figure 1:
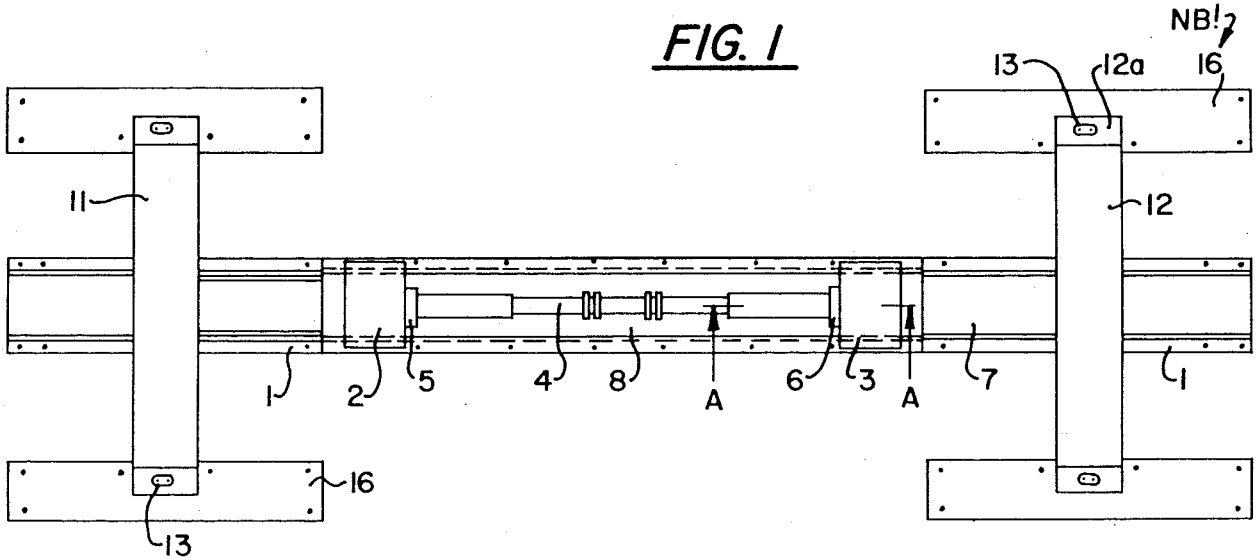
FIG. 1 is a top plan view of a device according to the invention in normal position for mounting on a usual open freight car.
Figure 2:
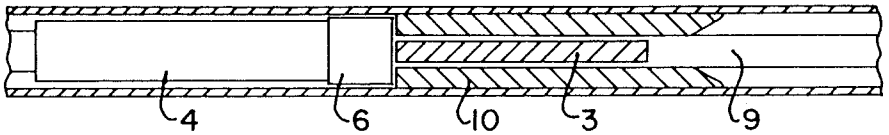
FIG. 2 is a longitudinal section of part of the device in FIG. 1 taken along the arrows A—A.

A plan view of a device for performing the method according to the invention to be mounted on a usual open-sided wagon, is shown in FIG. 1. The device comprises an elongated guide beam intended to be mounted with its longitudinal direction oriented lengthwise of an open-sided wagon. The guide beam is fixed to the floor of the wagon in a suitable manner, and, if the floor is made of wood, the guide beam preferably is screwed into the floor. Two stop shoulders, 2 and 3, are fastened to the guide beam in a spaced relationship. A double-acting buffer 4 is arranged in the guide beam between these stop shoulders, said buffer being provided with mounting plates 5 and 6 at its ends, which plates abut the stop shoulders 2 and 3, respectively, in the unloaded state of the buffer 4. Furthermore, a movable beam 7, extending across the main portion of the length of the guide beam and provided with a vertical recess 8, where the buffer 4 is arranged, is disposed in the guide beam 1. Moreover, the movable beam 7 has central horizontal recesses 9 at the ends of the vertical recess, only one of which is apparent from the figures, so that the movable beam can be moved with the stop shoulders 2 and 3 enclosed in the horizontal recesses. On both sides of the horizontal recesses, the movable beam 7 has impact shoulders 10 which, in the unloaded position of the buffer, are flush with the stop shoulders 2 and 3, with their ends facing the mounting plates of the buffer, as is apparent from FIG. 2, and abut the mounting plate. The impact shoulders 10, when the movable beam 7 is moved, abut the mounting plate of the buffer in the direction of motion in order to press together the buffer, as is apparent from FIG. 4. At the ends of the movable beam 7, container beams 11 and 12 are arranged which extend substantially perpendicularly to the movable beam 7 and the guide beam 1. At their outer ends, the container beams 11 and 12 are provided with container pins 13 to support a container, not shown. The container beams 11, 12 are preferably bent downwards at their outer ends and have a lower portion **12*a*, as is apparent from FIG. 5, on which the container pin 13 is disposed. This lower portion of the container beam 11, 12 has on its underside specially arranged sliding blocks 14 which are adapted to slide on specially arranged sliding surfaces 15 on sliding plates 16 screwed or attached in another way to the wagon floor. These sliding plates are preferably arranged separately at each end of the container beams 11 and 12, as is apparent from FIGS. 1 and 3. The length of the sliding plates 16 is adapted so that the container beams, with their sliding blocks, can be moved on the sliding plates to the whole extent permitted by the rest of the device, as will be explained more closely below. In order to obtain a sliding friction that is low enough, the surfaces of both the sliding blocks 14 and the sliding surfaces 15** are preferably made of tetrafluoroethylene.

Figure 3:
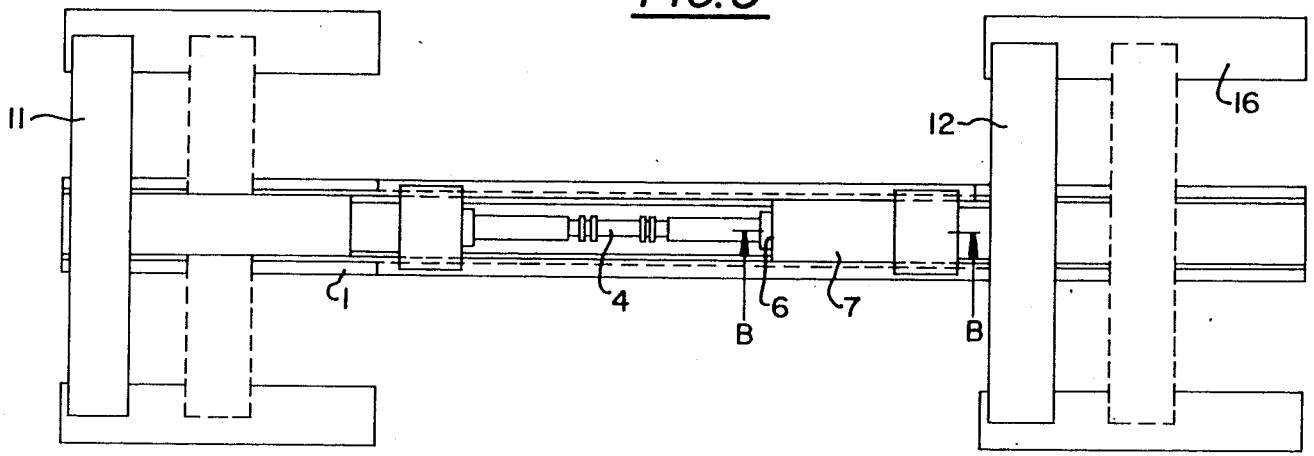
FIG. 3 is a view corresponding to that in FIG. 1 with the container supporting part moved towards one end of the device.
Figure 4:
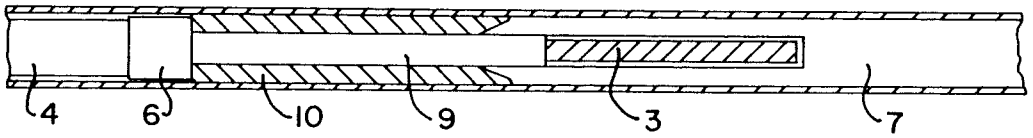
FIG. 4 is a section corresponding to that in FIG. 2 but taken along the arrows B—B of the moved device in FIG. 3.

The function of the device described above is as follows:

When a container is placed with its load on the device the container is arranged so that the container pins 13 engage from below the recesses disposed in the container and intended for the container pins. The movable beam 7, with its associated container beams 11 and 12, is then in the position shown in FIG. 1 with the buffer 4 substantially unloaded. When the wagon on which the device is mounted moves and is abruptly braked or receives a bump, the movable beam 7 with the container beams 11 and 12 supporting the container will be moved in one direction due to the forces of inertia acting on the container. FIGS. 3 and 4 show the movable beam moved to its left end position, while the position of the container beams 11 and 12 in an unloaded state is shown with dashed lines in FIG. 3. When moving the movable beam 7, the impact shoulders 10 abut the mounting plate 6 of the buffer 4 and compress the buffer 4. The sliding blocks 14 of the container beams will then slide on the sliding surfaces 15 of the sliding plates 16. When the buffer 4 is compressed, its resistance is increased more and more and will damp, in this way, the motion of the movable beam 7 and, consequently, the container. The maximum displacement that can be taken up is decided by the compression to which the buffer 4 can be subjected, on one hand, and, on the other hand, there is a mechanical stop provided by the stop shoulder 3 limiting the motion of the movable beam 7 by knocking against the bottom of the horizontal recess 9 in the movable beam, as indicated by FIG. 4. When compressing the buffer 4 according to FIG. 3, the buffer will abut with its mounting plate 5 on the stop shoulder 2 fixedly mounted in the guide beam 1 and cannot be moved further to the left.

The maximally-permitted displacement can, for instance be 760 mm in each direction from the normal position. In order that usual ISO-containers might be transported by means of the device of the invention on a usual open-sided wagon, the device must not have a height exceeding about 200 mm.

In order that shifting platforms—Wechselbehälter according to DIN 70013—might also be transported on the device of the invention, it must be possible to vary the height of the container pins 13. For shifting platforms, a lower placement of the container pin is required than for transport of ISO-containers, in order to get room within the load profile. At the lower placement, the guide tunnel of the shifting platform straddles the guide beam of the container equipment. The position of the container pin 13 at transport of shifting platforms is shown with continuous lines in FIG. 5, while the position of the container pin for transport of ISO-containers is shown by dot-and-dash lines in FIG. 5. In order to manage these two objects, a special arrangement for disposing the container pin has also been invented for the device of the invention, which is described hereinbelow.

Figure 5:
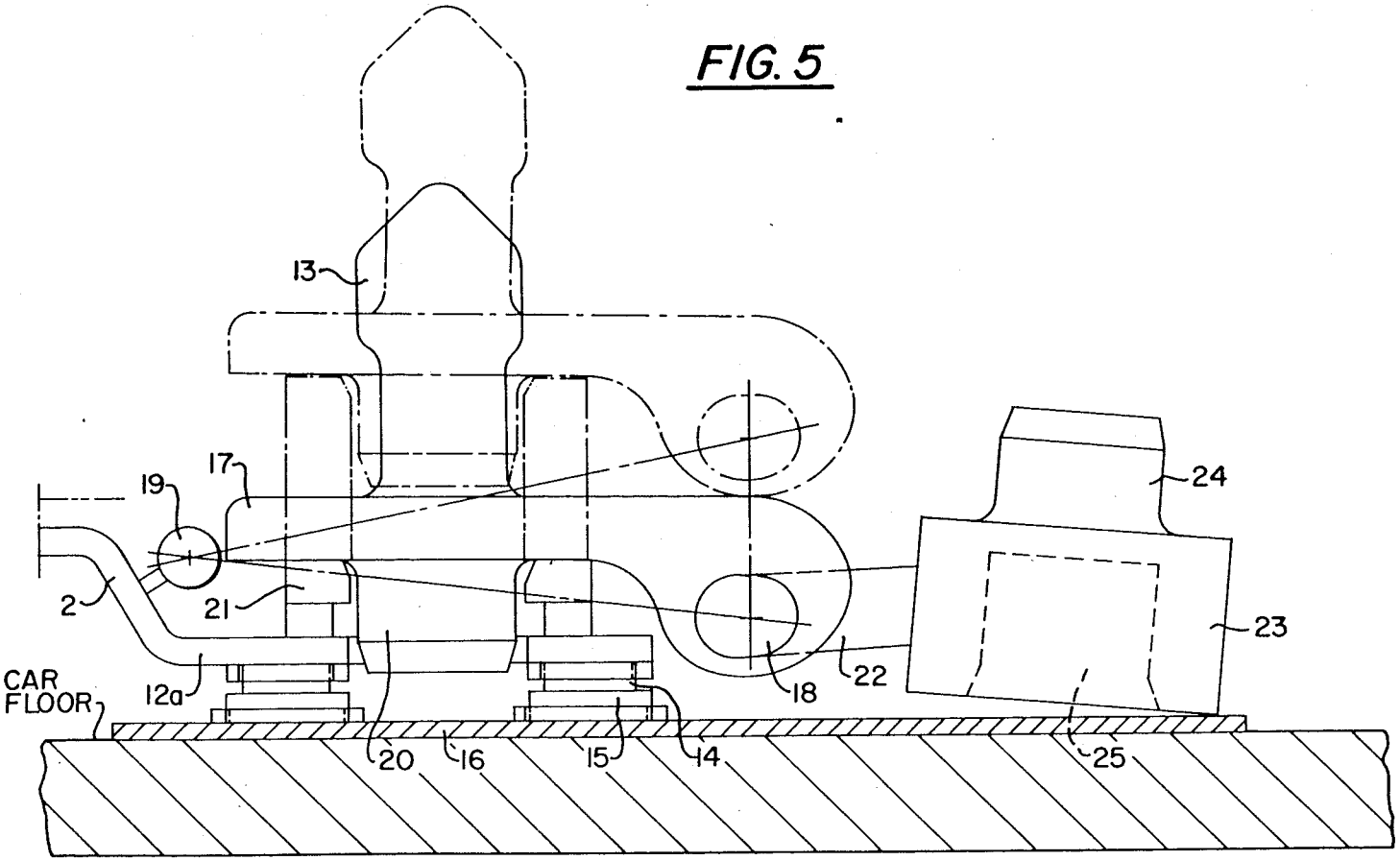
FIG. 5 is a schematical view of the attachment of a container pin of the device according to the invention to enable its adjustment in different vertical positions.

The container pin 13 is arranged on a plate 17, which is provided with a hinge 18 at its end facing away from the guide beam 1, a link, not shown, being attached to the hinge, the link being freely turnable in the hinge 18 and rotatably connected to an interior hinge 19 at its other end. The interior hinge 19 is attached to the container beam. Thus, the container pin 13, with its plate 17, can be turned around the interior hinge 19. On the underside of the plate 17, a projecting member 20 is arranged which fits into a bracket 21 attached to the lower portion 12*a* of the container beam. Moreover, a further link 22 is rotatably attached to the hinge of the plate. This hinge is connected to a raising member 23 which has a projecting member 24 on one of its sides, having the same form as the projecting member 20 and adapted to be received in the bracket 21, and has on its other side a recess 25 of substantially the same form as the opening in the bracket 21, to be able to receive the projecting member 20 on the plate 17 of the container pin. Thus, the placement of these members is shown in FIG. 5, with continuous lines indicating transport of shifting platforms, and the placement of the same members being shown with dash-dotted lines for indicating transport of ISO-containers. In order to raise the container pin 13 from the position shown with continuous lines, the container pin with the plate 17 is swung upwards, anti-clockwise, about the interior hinge 19, after which the raising member 23 is also swung clockwise and in below the plate 17 of the container pin, so that the recess of the raising member engages the projecting member 20 of the plate 17, after which the whole unit is lowered backwards in a clockwise direction, so that the projecting member 24 of the raising member 23 is forced down into the bracket 21 instead of the projecting member 20 of the plate 17. These members have then entered the position shown by the dash-dotted lines.

In order to bridge the difference in height between shifting platforms and ISO-containers, the height of the raised portion 23 should be about 60 mm.

I claim:

1. A method for cushioning a containerized shipment by railroad flatcar against sudden accelerations and decelerations longitudinally of the flatcar due to jerking and bumping of the flatcar, comprising:

providing a railroad flatcar having a flat floor;

providing a container cushioning device which includes:

a longitudinally extending guide beam;

a plurality of longitudinally extending sliding plates;

a double-acting buffer heaving two opposite ends;

a longitudinally-extending movable beam mounted on said guide beam for limited longitudinal movement in two axially opposite directions and operatively associated with said double-action buffer for tending to damp longitudinal motion of said movable beam when said movable beam moves longitudinally in either of said axially opposite directions;

two axially spaced stops secured on said guide beam for limiting longitudinal movement of said movable beam in said two axially opposite directions;

two longitudinally spaced, transversally extending container beams secured to said movable beam for movement therewith in said two axially opposite directions;

each container beam having at least one sliding block;

said container beams, among them, having a sufficient number of appropriately-spaced, upwardly-projecting pins mounted thereon, for removably engaging alternatively in all four corner fittings of an ISO container;

removably screwing the guide beam onto the flat floor of the railroad flatcar so that the guide beam extends longitudinally of the flatcar;

disposing said sliding plates on said flat floor of said railroad flatcar spaced laterally to the left and to the right of said guide beam so that each sliding block of each container beam is disposed in sliding engagement with a respective sliding plate;

removably screwing each sliding plate onto the flat floor of the railroad flatcar;

lowering an ISO container onto said container cushioning device, so that each of four corner fittings of the container is mounted on a respective said upwardly-projecting pin; and moving the railroad flatcar bearing said container along a rail line with said device on which said container is mounted cushioning said container against sudden accelerations and decelerations longitudinally of the flatcar due to jerking and bumping of the flatcar.

2. The method of claim 1, further comprising the subsequent steps of:

at a destination, lifting the ISO container away from said container cushioning device; and unscrewing and removing said guide beam and said sliding plates from said flat floor of said railroad flatcar.

3. The method of claim 2, wherein:

said step of providing said container device further includes:

providing said sliding plates and sliding blocks with respective working surfaces coated with polytetrafluoroethylene and disposed in sliding engagement with one another.

4. The method of claim 2, wherein:

said step of providing a railroad flatcar having a flat floor comprises providing said flat floor to be made out of wood.

* * * * *